United States Patent [19]

Katz

[11] 4,180,114

[45] Dec. 25, 1979

[54] PORTFOLIO

[76] Inventor: Diane Katz, 251 W. 92nd St., New York, N.Y. 10025

[21] Appl. No.: 909,612

[22] Filed: May 26, 1978

[51] Int. Cl.[2] ..... A45C 3/00

[52] U.S. Cl. ..... 150/28 R; 150/52 R

[58] Field of Search ..... 150/1.7, 28 R, 52 R; 190/43

[56] References Cited

U.S. PATENT DOCUMENTS

| | | | |
|---|---|---|---|
| D. 157,266 | 2/1950 | Kiernan | 150/28 R |
| D. 159,299 | 7/1950 | Schlessinger | 150/28 R |
| 1,787,706 | 1/1931 | Stember | 150/28 R |
| 2,068,547 | 1/1937 | Jung | 150/28 R |
| 3,831,651 | 8/1974 | Leahy | 150/28 R |
| 4,085,873 | 4/1978 | Schweitzer | 150/28 R |

*Primary Examiner*—Ro E. Hart

*Attorney, Agent, or Firm*—Kirschstein, Kirschstein, Ottinger & Cobrin

[57] ABSTRACT

A flexible portfolio for flat planar objects such as works of art, acetate sheets, posters, pieces of paperboard or cardboard such as signs, illustrations, etc. The portfolio includes two rectangular flexible panels which are equal sized and in registration. Three edges of one panel are secured to the respective three edges of the other panel, i.e., the secured three edges are two end edges and a middle edge. One end of each end edge is contiguous with an end of the middle edge. A zipper having two discrete rectilinear stringers is mounted to one of the panels; the stringers are mateable when juxtaposed upon the deformation of the flexible panels into a cylindrical configuration. One stringer is mounted to the panel parallel to and spaced from the middle edge. The other stringer is mounted to the panel at a location contiguous with the middle edge. At least one flexible linear strap is mounted to at least the one panel so that the portfolio is portable.

29 Claims, 16 Drawing Figures

26
24
88
33
56
20
57
38
22
28
50
40
104
52
106
40
36
42

20
62
84
96
63
72
88
86
74
98
80
82
118
116
69
70
60
64
92
116
108
68
66
80
84
86
82
52
50
116
84
69
86
80
90
36
82
90

20
63
96
62
22
88
22
118
98
80
82
116
64
114
84
86
66
92
80
82
52
94
50
86
118
82
80
90
116
84
36
112
90

63
98
20
96
62
22
22
82
80
92
116
84
88
86
94
66
64
112
68
118
82
80
52
50
69
116
84
86
118
80
36
82

20
28
71
38
80
33
24
52
80
58
26
86
88
94
60
64
92
71
82
80
66
90
62
116
84
36
118
90
82

20
71
58
71
94
66
80
92
36
60
90
38
64
80

20
71
80
92
38
60
64
90
58
36

PORTFOLIO

BACKGROUND OF THE INVENTION

1. Field of the Invention

A portable portfolio for artists, students, people in advertising, etc.

2. Description of the Prior Art

People in various occupations or avocations, hobbyists, artists, students, service people such as messengers and delivery persons, etc., encounter a need either occasionally or regularly for a portable portfolio or knapsack to carry such diverse objects as works of art done on canvas, bristol board, or paperboard or the like in oils or water colors, acetate sheets, maps, tools, posters, pieces of paperboard or cardboard such as signs, etc. In addition, shoppers, people going for an outing, picnic, etc., at a beach, seaside resort, park, etc., often have a need for a portable lightweight container to hold and carry diverse objects such as beach towels, swimsuits, picnic lunches, etc., and in many instances the conventional picnic basket is neither convenient nor easy to handle. This is particularly true when the person is traveling in crowded public mass transit.

Diverse configurations of portfolios, knapsacks, bags, receptacles, map cases, containers, baskets, etc., have been developed in the prior art for diverse specialized functions. Among the pertinent prior art may be mentioned U.S. Pat. Nos. 1,134,285; 1,606,107; 2,293,979; 2,659,404; 2,661,570; 3,221,959 and 3,749,233.

SUMMARY OF THE INVENTION

1. Purposes of the Invention

It is an object of the present invention to provide an improved flexible portfolio.

Another object is to provide a flexible portfolio which is portable and may be used to transport flat planar objects such as works of art.

A further object is to provide a flexible portfolio which may be readily adjusted and manipulated into a multiple choice of configurations, namely, a rolled-up cylindrical shape case, a tote bag, or a flat case.

An additional object is to provide a flexible portfolio which is three cases in one.

Still another object is to provide a flexible portfolio which is unique, lightweight and attractive, both visually and in terms of usuage.

Still a further object is to provide a flexible portfolio which may be snapped and/or zipped into various sizes and shapes.

An object is to provide a flexible portfolio which can carry almost any size work of art, either flat or rolled.

An object is to provide a flexible portfolio whose shape is readily converted from flat portfolio to rolled portfolio and presentation case.

An object is to provide a flexible portfolio which may be either carried over the shoulder of a person or carried by hand.

An object is to provide a flexible portfolio having integral pockets.

An object is to provide a flexible portfolio which may be readily adjusted to any one of three shapes.

An object is to provide a flexible portfolio which may be conveniently hung on any surface or projection such as skirt hangers, walls, posts, etc.

An object is to provide a flexible portfolio which is a combination flat and rolled portfolio and presentation case.

These and other objects and advantages of the present invention will become evident from the description which follows.

2. BRIEF DESCRIPTION OF THE INVENTION

In the present invention, the flexible portfolio is characterized by the provision of first and second generally rectangular flexible panels which are of generally equal size and in registration. Three edges of the first panel are secured to the respective opposed three edges of the second panel by suitable means such as stitching, stapling, gluing, etc. The three edges of each panel are two end edges and a middle edge, with one end of each end edge being contiguous with an end of the middle edge. A zipper means having discrete first and second rectilinear stringers is provided. The stringers are mateable when juxtaposed upon the deformation of the flexible panels into a cylindrical configuration. The first stringer is mounted to the first panel parallel to and spaced from the middle edge of the first panel. The second stringer is mounted to the first panel by mounting means contiguous with the middle edge of the first panel. The structure of the flexible portfolio is completed in its basic configuration by the provision of flexible linear strap means mounted to at least the first panel so that the portfolio is portable.

In a preferred embodiment, the middle edge of the panels is longer than the end edges of the three secured edges. It is also preferred for ease of assembly that the first panel and the second panel be equal-sized portions of a single continuous flexible element. In this case, the means securing the middle edge of the first panel to the middle edge of the second panel will be a rectilinear fold generally at the middle of the element, with the fold generally parallel to the unsecured edges of the element, i.e., the unsecured edges of the panels.

Typically, at least one end of both the first stringer and the second stringer terminates short of an end edge of the portfolio, with the respective one ends of the stringers being in registration. In this regard, in a preferred embodiment both ends of both the first stringer and the second stringer terminate short of the respective end edge of the portfolio, and each end of each stringer is in registration with the respective end of the other stringer.

It is preferred that each end of the strap means be secured to the first panel at and adjacent to the respective end edge of the first panel, so that the strap means extends from one end edge of the first panel to the other end edge of the first panel and between the first stringer and the second stringer. In this regard, in a preferred embodiment the strap means is parallel to the stringers so that the stringers straddle the strap means.

In an alternative embodiment of strap means, which may be provided in conjunction with the strap means described supra or as an alternative to the strap means described supra, each end of the strap means is secured to the first panel between the first stringer and the unsecured edge of the first panel. In this embodiment, the two ends of the strap means are preferably spaced apart. It is also preferred that each end of an additional flexible linear strap means be secured to the second panel at and adjacent to the unsecured edge of the second panel. In this regard, preferably the additional strap means will be of generally the same length as the strap means secured to the first panel, and will be in registration with the strap means secured to the first panel.

Typically, the panels are composed of cloth such as water-repellent canvas duck, corduroy, cotton or nylon fabric, or the like, however, the panels could alternatively be composed of a flexible plastic such as polyvinyl chloride or polyethylene, or soft leather, sheet nylon, or the like. In addition, the strap means will also be preferably composed of cloth or leather together with at least one metallic buckle composed of brass, steel, or the like.

In a preferred embodiment, at least one securing means extends between the first panel and the second panel adjacent to and spaced from one end edge of the panels, so that a pocket is formed, which pocket will have a mouth defined by a portion of the unsecured edges of the panels. Preferably, the at least one securing means, which may be stitching, gluing, stapling, a plurality of spaced apart snap fasteners, or a zipper, will be generally linear and in many typical instances, the linear securing means will be rectilinear and will extend generally parallel to the one end edge of the panels. In this case, it is preferred that the rectilinear securing means will extend from proximately the unsecured edges of the panels to the middle edges of the panels. With further regard to the securing means in general, in a preferred embodiment the number of securing means is two, with a first securing means being adjacent to one end edge of the panels, and with a second securing means being adjacent to the other end edge of the panels. In this case, for reasons of symmetry and appearance, it is preferred that the distance between each securing means and its respective end edge of the panels be equal, especially at the mouth of the pocket.

It is preferred that at least one attachment means be mounted to one of the panels adjacent to the one end edge of the panels, with a mating attachment means being mounted to this one panel, the mating attachment means being spaced away from the one attachment means, so that a portion of the portfolio adjacent to the one end edge of the panels may be folded and attached to the balance of the portfolio, with the at least one attachment means and the mating attachment means being detachably attachable to each other. It is further preferred that the at least one attachment means be a first plurality of discrete attachment means, each of the first plurality of discrete attachment means being spaced from adjacent discrete attachment means and mounted to one of the panels adjacent to the one end edge of the panels. In this case, the mating attachment means will be a second plurality of discrete attachment means mounted to the one of the panels in a rectilinear pattern generally parallel to the one edge of the panels.

With further regard to the general concept of providing the at least one attachment means and the mating attachment means as described supra, in a preferred embodiment, at least one securing means extends between the first panel and the second panel, which at least one securing means is disposed between the at least one attachment means and the mating attachment means and is spaced generally equally from both the at least one attachment means and the mating attachment means.

Typically, the at least one attachment means and the mating attachment means are mating portions of at least one snap fastener, although alternatively these attachment means could be one or a plurality of buttons and buttonholes, spaced apart stringers of a zipper, mating portions of Velcro or the like. In this regard, Velcro is basically an attachment means having mating portions consisting of two flexible tapes or patches. One tape has a multiplicity of closely spaced hooks; the other tape has a multiplicity of closely spaced loops in the form of a continuous pile. The hooks and loops are plastic monofilaments shaped to the desired configurations. When the tapes are pressed against one another, the hooks engage the loops to provide a closure which is reasonably resistant to opening forces. However, due to the resiliency of the monofilaments, the tapes can be disengaged from each other either by applying a substantial pull in a direction perpendicular to their planes or by peeling them apart. Fasteners such as Velcro, and constituting two patches or tapes of different natures, are described in U.S. Pat. Nos. 2,717,437; 3,009,235; 3,076,244; 3,083,737; 3,147,528; 3,154,837 and 4,058,853.

In a preferred embodiment, one side of one end portion of at least one flexible rectilinear strip is attached to one of the panels, an attachment means is mounted to the other side of the one end portion of the strip, and a mating attachment means is mounted to one side of the other end portion of the strip, so that the strip may be formed into a loop having the one end portion and the other end portion of the strip attached to each other, with the attachment means and the mating attachment means being detachably attachable to each other. The attachment means and the mating attachment means are typically mating portions of Velcro, or mating portions of a snap fastener, or a button and buttonhole, or the like. In one preferred embodiment of the loop configuration as described supra, the number of strips is two and the two strips are mounted to the same panel and spaced apart. In this case the strips when formed into loops are in registration, with the loops being generally coaxial. One purpose of this configuration is to accommodate the mounting of a rectilinear object such as an umbrella or T-square on the portfolio. It is further preferred, when the two strips configuration is provided, that one strip be mounted to the panel adjacent to one end of the first stringer and the other strip be mounted to the panel adjacent to the other end of the first stringer, with the axis of the coaxial loops, when the strips are formed into loops, being generally parallel to the first stringer.

In will be understood that, within the context of the present invention, the term securing means is intended to include and encompass any of the diverse individual securing means mentioned supra. In this regard, the selection of a suitable securing means for a particular location, function or service in the present flexible portfolio will be dependent on a variety of factors and considerations such as cost, durability, etc., and the selection of an optimum securing means for a particular service in the portfolio will be based in any instance on the individual or group judgment of the design personnel specifying the commercial portfolio.

The improved flexible portfolio of the present invention provides several salient advantages. The portfolio is portable and may be used to transport flat planar objects such as works of art. The portfolio may be readily adjusted and manipulated into a multiple choice of configurations, namely, a rolled-up cylindrical shape, a tote bag, or a flat case. Thus, the present portfolio is three cases in one. The portfolio is unique, lightweight and attractive, both visually and in terms of usage. The portfolio may be snapped and/or zipped into various sizes and shapes. The portfolio can carry almost any size work of art, either flat or rolled, i.e., the shape of the portfolio is readily converted from flat portfolio to rolled portfolio and presentation case. The portfolio may be either carried over the shoulder of a person or carried by hand. In a preferred embodiment, the portfolio has integral pockets for convenience in carrying rulers, brushes, pens, pencils, bottles of ink or watercolors or paste or oils for oil paintings or diverse other artist's supplies, or any other desired small articles. The portfolio may be readily adjusted in a matter of seconds to any one of the three shapes. The portfolio may be conveniently hung on any surface or projection such as skirt hangers, walls, posts, a nail or hook, etc. Finally, an advantage of the present flexible portfolio is that it is a combination flat and rolled portfolio and presentation case.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
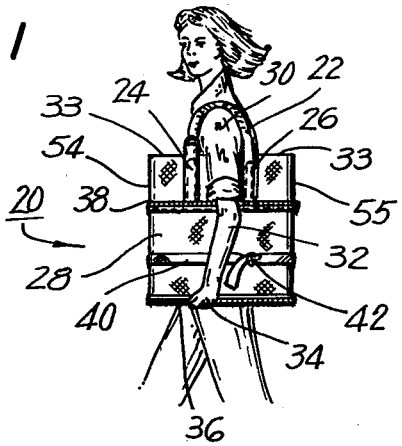
FIG. 1 is an elevation view showing the portfolio being carried in the tote form.
Figure 2:
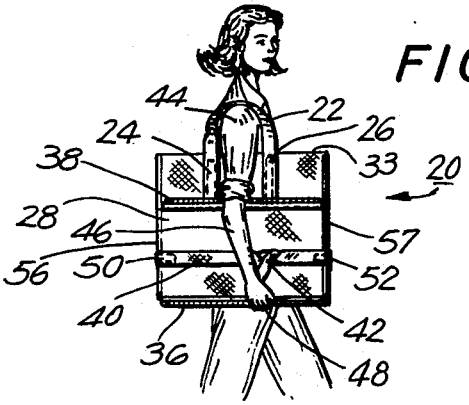
FIG. 2 is an elevation view showing the portfolio being carried in the flat case form.
Figure 3:
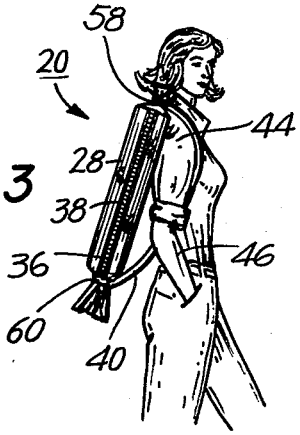
FIG. 3 is an elevation view showing the portfolio being carried in the roll form.

Referring now to FIGS. 1, 2 and 3, the three basic modes of carrying the present portfolio are shown. The portfolio 20 is shown in FIG. 1 being carried in the tote position and form by a person. A cloth strap 22 is attached at its ends 24 and 26 by stitching or the like, to a flexible rectangular cloth panel 28 of the portfolio 20. The strap 22 extends over and rests on the one shoulder 30 of the person; an arm 32 of the person has been extended through the opening defined by strap 22 and the unsecured top edge 33 of panel 28. A hand 34 of the arm 32 is shown grasping a portion of a lower rectilinear horizontal stringer 36 of the portfolio, which stringer 36 extends along and is secured to the lower secured edge of the portfolio, which edge in this embodiment of the invention is a fold in a single element consisting of panel 28 and a second panel, not shown, which second panel is disposed between the panel 28 and the torso of the person.

The end attachments 24 and 26 of the strap 22 are disposed between the unsecured top edge 33 of the panel 28 and a portion of an upper rectilinear horizontal stringer 38, which is mounted to the panel 28, by stitching, above and generally parallel to the stringer 36 mentioned supra.

Also shown in FIG. 1 is a portion of a cloth strap means 40 having free terminal ends adjustably attached to each other at 42 by means of a buckle or the like. The strap means 40 as shown is disposed generally horizontally on the panel 28 between the stringers 36 and 38 so that the stringers 36 and 38 straddle the strap means 40.

FIG. 2 shows the portfolio 20 being carried by the person on the other shoulder 44 and via the other arm 46 and hand 48 of the person. As shown in FIG. 2, the portfolio 20 has been extended to the flat case form, with the stringers 36 and 38 and strap means 40 being shown extended to full length on the panel 28 side of the portfolio 20. A portion of the ends 50 and 52 of the strap means 40 are shown in FIG. 2 as secured to the cloth panel 28 by stitching or the like.

In both the FIG. 1 and FIG. 2 embodiments of the invention, the respective edges 54 and 55, and 56 and 57, are folded-over side edges of the entire portfolio 20. In addition, in both FIGS. 1 and 2 the obverse side of the flat form of the portfolio 20 is shown.

FIG. 3 shows the roll form of the portfolio 20 being carried over the shoulder 44 of the person. In this case the strap means 40 has been extended to a greater length by appropriate adjustment of the means 42, and the stringers 36, 38 of the zipper means have been mated and secured to each other by juxtaposing the stringers 36, 38, after the deformation of the flexible cloth panels such as 28 into a cylindrical configuration, and thereafter by zipping the stringers 36, 38 together. The ends of the cylindrically configured portfolio have been secured by appropriate manipulation of opposed flexible rectilinear strips 58, 60 having terminal mating attachment means at their ends, as will appear infra.

Figure 5:
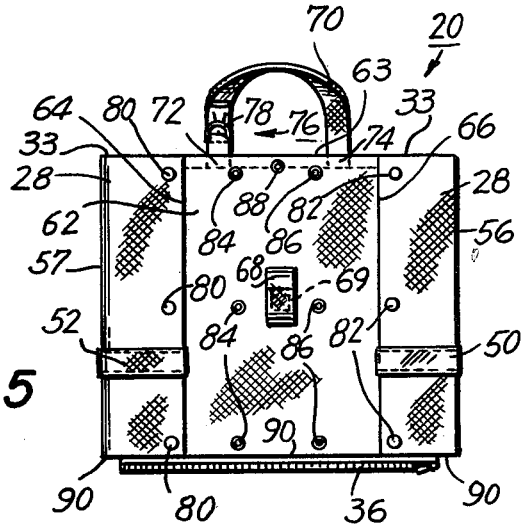
FIG. 5 is an enlarged elevation view of the portfolio form of FIG. 2 (flat case) showing the reverse side of the portfolio as in FIG. 2.
Figure 4:
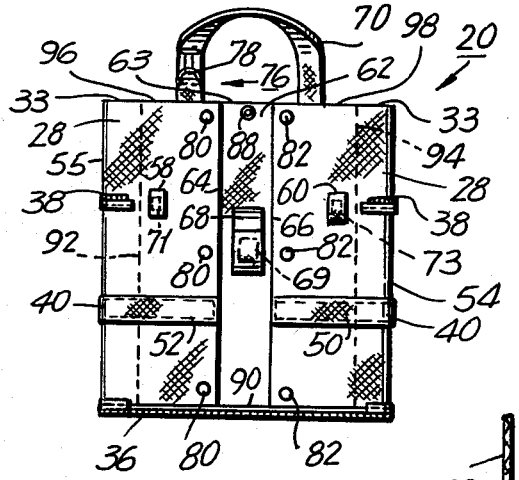
FIG. 4 is an enlarged elevation view of the portfolio form of FIG. 1 (tote form) showing the reverse side of the portfolio as compared to FIG. 1.

FIGS. 4 and 5 show, in larger scale, the reverse side of the portfolio 20 as previously shown and described in, respectively, FIGS. 1 and 2. A flexible rectangular cloth panel 62 of the portfolio 20 is shown in both FIGS. 4 and 5. The panel 62 has an unsecured upper edge 63 which is juxtaposed with the edge 33 of the panel 28 described supra. In most instances, the edges 33 and 63 will be parallel and in registration with each other, and when the material being carried by the portfolio 20 is both flat and thin, as would be the case if, e.g., only one sheet of artwork or acetate was being carried in the portfolio, then the unsecured edges 33 and 63 would be contiguous in practice.

The panel 62 is equal in size to, and in registration with, the panel 28. The edges 64 and 66 represent the secured edges of the respective panels 28 and 62 (as mentioned supra, the edges 54 and 55 in FIG. 4 and 56 and 57 in FIG. 5 represent edges made by opposed folding-over of opposed portions of the sides of the entire flat portfolio including both of the panels 28 and 62).

The FIGS. 4 and 5 also show a central flexible rectilinear strip 68 which has been looped and secured at its ends by appropriate manipulation, i.e., the ends of the strip 68 have terminal mating attachment means, as will appear infra. In this regard, a patch 69 of Velcro disposed at one end of the strip 68 is shown in phantom outline. FIG. 4 also shows the opposed lateral flexible rectilinear strips 58 and 60, which strips 58 and 60 are generally similar in configuration to the strip 68 except that the strips 58 and 60 are smaller, and the respective Velcro terminal securing means 71 and 73 have a slightly different orientation from that of patch 69, as will appear infra. In addition, FIGS. 4 and 5 also show a cloth strap means 70 which is generally identical in configuration to, and in registration with, the strap means 22 described supra; the strap means 70 is attached to the panel 62 by terminal securing means 72, 74 (FIG. 5) consisting of stitching or the like. The strap means 70 includes adjustable means, generally designated as 76, for attaching its free terminal ends to each other. The means 76 includes a metallic buckle 78 or the like.

FIGS. 4 and 5 also show snap fasteners for detachably attaching side portions of the portfolio together after appropriate folding along either fold lines 54, 55 or 56, 57. Referring now to FIG. 5, two opposed rectilinear rows 80, 82 consisting of discrete female portions of snap fasteners are attached to the panel 28, and the rows 80, 82 are disposed adjacent to and in parallel with the respective secured edges 64 and 66. These female portions of snap fasteners 80, 82 as shown in FIG. 4 have been attached to respective mating rows of male portions of snap fasteners, shown in FIG. 5 as rows 84, 86. The rows 84, 86 of male portions of snap fasteners are secured to the panel 62. Similar outer rows of male portions of snap fasteners, not shown, are provided and secured to the panel 62 parallel to and spaced from the rows 84, 86; each of the rows 80, 82 of female portions are snapped and secured to one of these outer rows of FIG. 5, as mentioned supra. A single snap fastener 88 at the upper middle of the panel 62 adjacent edge 63 serves to detachably attach together the panels 28 and 62 at their respective unsecured upper edges 63 and 33.

FIGS. 4 and 5 further show a horizontal fold line 90 at the lower end of the portfolio 20, which fold line 90 is juxtaposed with the stringer 36 and represents the folding of the middle of a single continuous element to form the two equal-sized panels 28 and 62; thus the fold 90 represents one embodiment of a lower horizontal means for securing the two panels 28 and 62 together, i.e., the fold 90 represents the secured middle edges of the panels 28 and 62. The side edges 64 and 66 of the respective panels 28 and 62, which side edges 64 and 66 are the side edges of the portfolio 20 when it is extended to full width, are secured by means of contiguous stitching of the panels 28 and 62 together adjacent edges 64 and 66. This contiguous stitching extends within the portfolio and adjacent the edges 64, 66 when the portfolio is assembled and therefore the contiguous stitching is not shown.

Referring now specifically to FIG. 4, the dashed vertical lines 92, 94 spaced from the respective edges 64, 66 are two lines of stitching which join the two panels 28 and 62 so that two lateral pockets having mouths at, respectively, 96 and 98, are formed.

Figure 6:
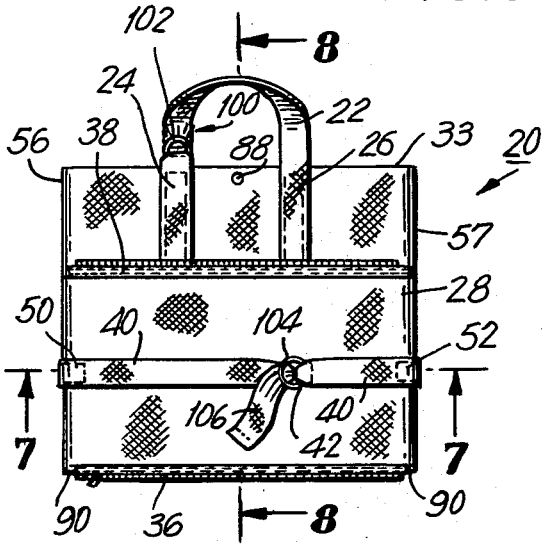
FIG. 6 is an enlarged elevation view of the portfolio form of FIG. 2 (flat case) showing the front (obverse) side of the portfolio as in FIG. 2.
Figure 8:
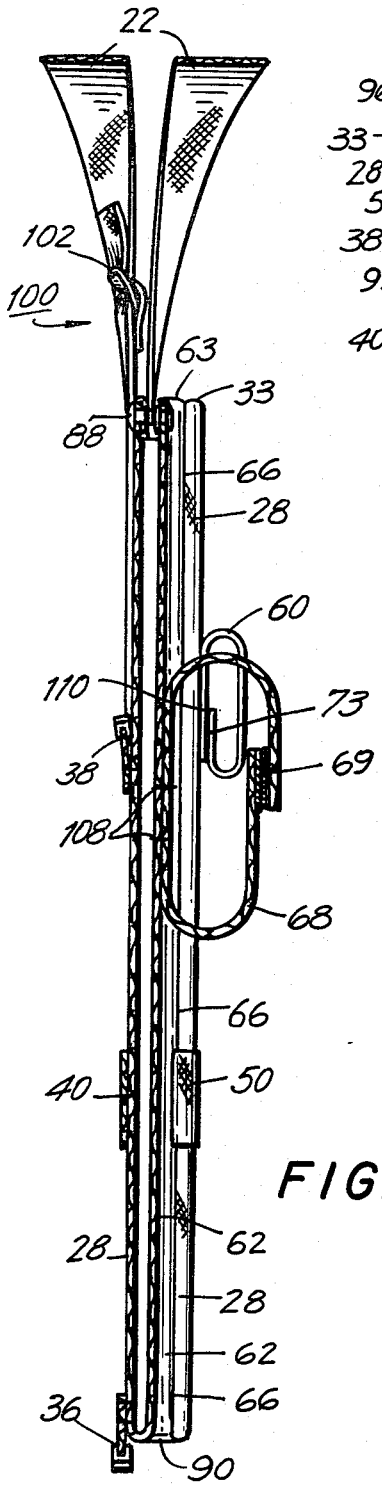
FIG. 8 is a sectional elevation view taken substantially along the line 8—8 of FIG. 6.
Figure 7:
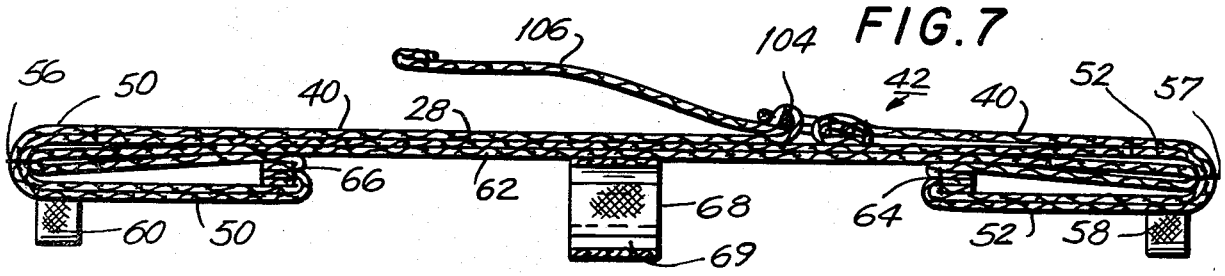
FIG. 7 is a bottom sectional plan view taken substantially along the line 7—7 of FIG. 6.
Figure 9:
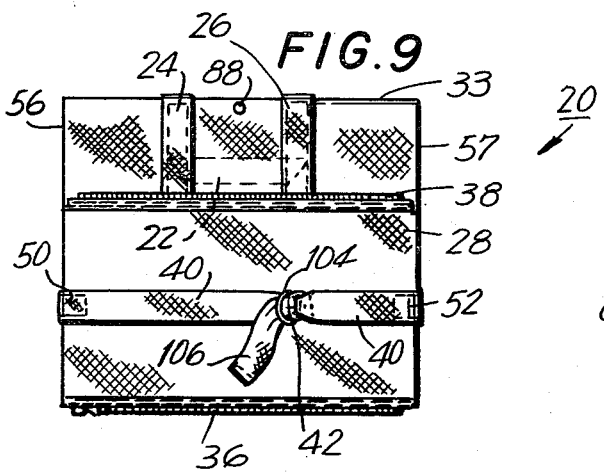
FIG. 9 is an elevation view showing the portfolio with upper strap handles disposed inside in preparation for assembly of the roll form.
Figure 10:
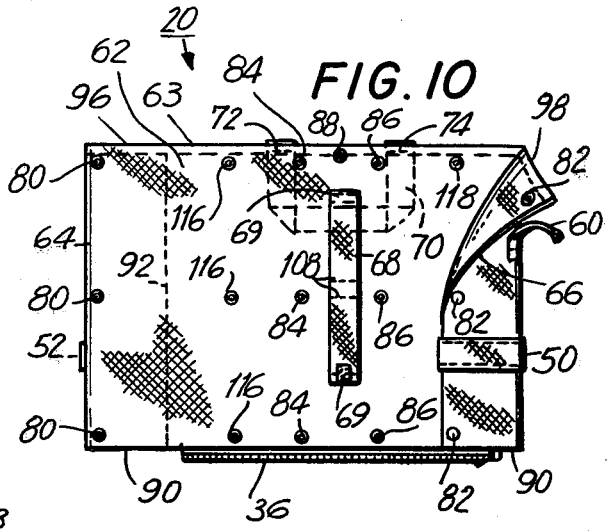
FIG. 10 shows the portfolio being opened up for mounting of a piece of artwork in the unit in the roll form.

Referring now to FIGS. 6, 7 and 8, details of the portfolio 20 as described supra are shown. The adjustable means 100 for attaching the free ends of the strap means 22 together is shown in enlarged scale; this means 100 includes a buckle 102. Likewise, the attachment means 42 described supra includes a buckle 104 (FIG. 6). A free end 106 of one half of the strap means 40 extends from the buckle 104. FIG. 8 shows details of the Velcro attachment 69 between the free ends of the strip 68 in enlarged scale; the Velcro attachment 69 forms the strip 68 into a loop. The middle of the strip 68 is secured to the panel 62 by stitching 108 (FIG. 8). Likewise, one side of one end of the strip 60 is secured to the panel 28 at 110, and the Velcro attachment 73 detachably attaches the other side of the one end of the strip 60 to the other end of the strip 60 so as to form a loop. The ends of a rectilinear object such as an umbrella or T-square may be horizontally inserted through the loops 58 and 60 so tht the object is mounted to the portfolio 20 and may be carried in situ together with the portfolio 20.

Figure 11:
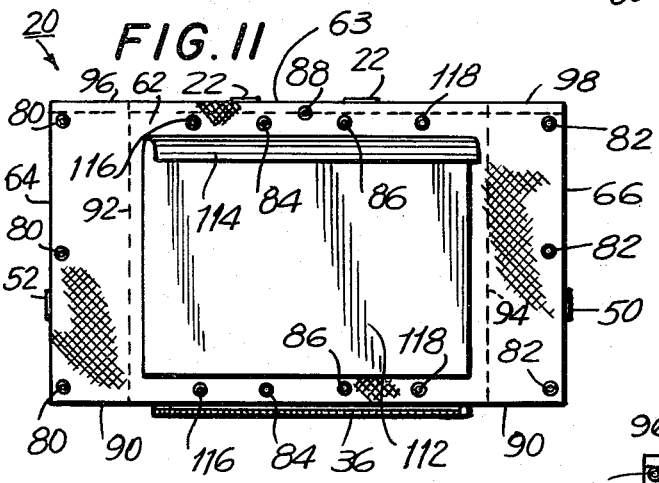
FIG. 11 shows the fully opened portfolio with artwork being rolled in place.
Figure 12:
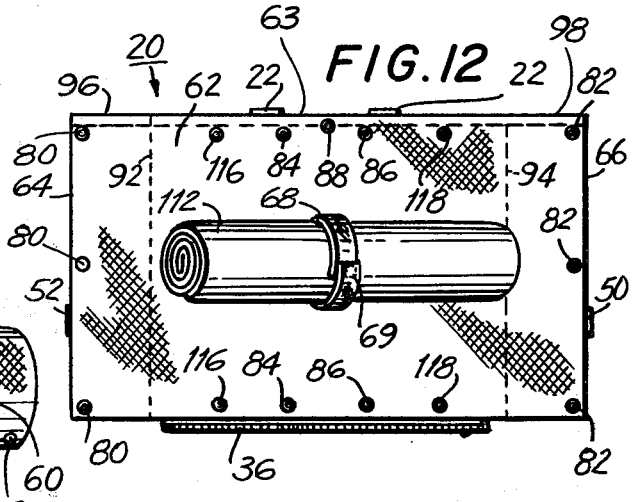
FIG. 12 shows the fully rolled-up and secured artwork mounted to the portfolio.
Figure 13:
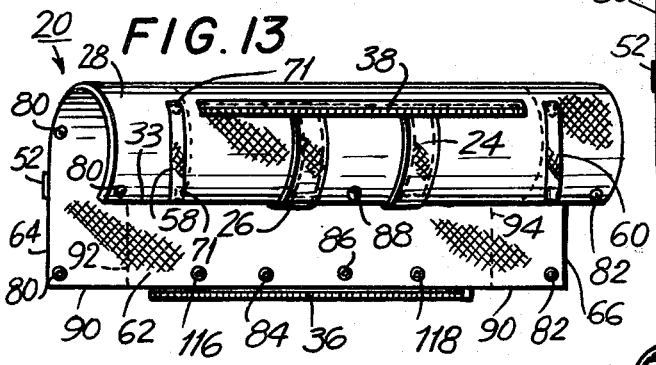
FIG. 13 shows the rolling up of the fully opened portfolio with the rolled-up artwork inside.
Figure 14:
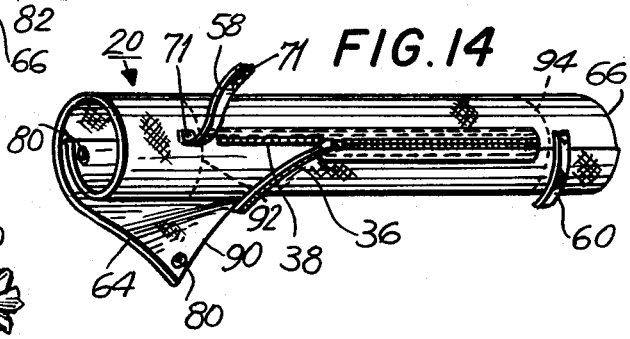
FIG. 14 shows the rolled-up portfolio with artwork inside being zipped up for closure.
Figure 15:
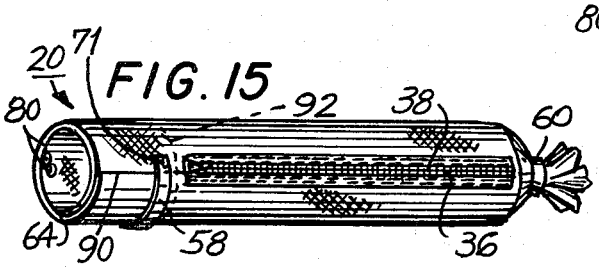
FIG. 15 shows the rolled-up portfolio with one end secured by a looped flexible rectilinear strip.

FIGS. 9–15 show the successive steps of rolling an originally flat piece of artwork 112 into a cylindrical configuration (FIG. 11) and detachably attaching the rolled-up artwork 112 to the unfolded portfolio 20 by means of the strip 68 (FIG. 12), followed by the rolling-up of the portfolio 20 into the cylindrical configuration of the roll form (FIG. 3). The successive steps of manipulation are self-evident from the FIGS. 9–15 taken in conjunction with the brief description of the drawings provided supra. It should be noted that FIG. 11 shows the preferred mode of rolling up the artwork, i.e., starting first with the upper side or end 114 of the artwork adjacent the upper snap fastener 88 and strap means 22. FIGS. 10–13 inclusive also show the outer rows 116, 118 of male portions of snap fasteners which, in one embodiment, cooperate with and are detachably attached to the respective female portions, respectively rows 80, 82, as shown in FIG. 5 described supra, to provide the flat case configuration of the portfolio 20 as shown in FIGS. 2 and 6, as well as in FIG. 5.

Figure 16:
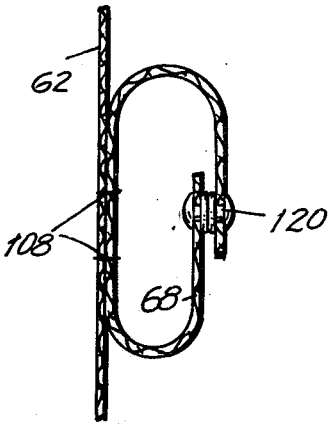
FIG. 16 shows an alternative embodiment of looped flexible rectilinear strip.

FIG. 16 shows an alternative form of detachable attachment means for attaching the ends of the strip 68 to each other, namely a snap fastener 120 which may alternatively be provided instead of the Velcro fastener 69. Similar considerations apply to the Velcro fastening means 71, 73 of the respective strips 58 and 60.

It thus will be seen that there is provided a portfolio which achieves the various objects of the invention and which is well adapted to meet the conditions of practical use.

As various possible embodiments may be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A flexible portfolio for flat planar objects such as works of art which comprises first and second substantially rectangular flexible panels, said panels being of substantially equal size and being in registration, means securing three edges of the first panel to the respective opposed three edges of the second panel, said three edges of each panel being two end edges and a middle edge, one end of each end edge being contiguous with an end of said middle edge, a zipper means, said zipper means having discrete first and second rectilinear stringers, said stringers being mateable when juxtaposed upon the deformation of the flexible panels into a cylindrical configuration, a first stringer of said zipper means being mounted to the first panel parallel to and spaced from the middle of said three edges of said first panel, a second stringer of said zipper means being mounted to the first panel by mounting means contiguous with the middle of said three edges of said first panel, and flexible linear strap means, said strap means being mounted to at least said first panel so that the portfolio is portable.

2. The flexible portfolio of claim 1 in which the middle edge of the panels is longer than the end edges of the three secured edges.

3. The flexible portfolio of claim 1 in which the first panel and the second panel are substantially equal sized portions of a single continuous flexible element, and the means securing the middle edge of the first panel to the middle edge of the second panel is a rectilinear fold substantially at the middle of said element, said fold being substantially parallel to the unsecured edges of said element.

4. The flexible portfolio of claim 1 in which at least one end of both the first stringer and the second stringer terminates short of an end edge of the portfolio, the respective one ends of the stringers being in registration.

5. The flexible portfolio of claim 4 in which both ends of both the first stringer and the second stringer terminate short of the respective end edge of the portfolio, and in which each end of each stringer is in registration with the respective end of the other stringer.

6. The flexible portfolio of claim 1 in which each end of the strap means is secured to the first panel at and adjacent to the respective end edge of the first panel so that the strap means extends from one end edge of the first panel to the other end edge of the first panel and between the first stringer and the second stringer.

7. The flexible portfolio of claim 6 in which the strap means is parallel to the stringers so that the stringers straddle the strap means.

8. The flexible portfolio of claim 1 in which each end of the strap means is secured to the first panel between the first stringer and the unsecured edge of the first panel.

9. The flexible portfolio of claim 8 in which the two ends of the strap means are spaced apart.

10. The flexible portfolio of claim 8 in which each end of an additional flexible linear strap means is secured to the second panel at and adjacent to the unsecured edge of the second panel.

11. The flexible portfolio of claim 10 in which the additional strap means is of substantially the same length as the strap means secured to the first panel and is in registration with the strap means secured to the first panel.

12. The flexible portfolio of claim 1 in which the panels are composed of cloth.

13. The flexible portfolio of claim 12 in which the cloth is water repellant canvas duck.

14. The flexible portfolio of claim 1 in which the strap means is composed of cloth together with at least one metalic buckle.

15. The flexible portfolio of claim 1 in which at least one securing means extends between the first panel and the second panel adjacent to and spaced from one end edge of the panels, so that a pocket is formed, said pocket having a mouth defined by a portion of the unsecured edges of the panels.

16. The flexible portfolio of claim 15 in which the at least one securing means is linear.

17. The flexible portfolio of claim 16 in which the linear securing means is rectilinear.

18. The flexible portfolio of claim 17 in which the rectilinear securing means is substantially parallel to the one end edge of the panels.

19. The flexible portfolio of claim 18 in which the rectilinear securing means extends from proximately the unsecured edges of the panels to the middle edges of the panels.

20. The flexible portfolio of claim 15 in which the number of securing means is two, a first securing means being adjacent to one end edge of the panels, and a second securing means being adjacent to the other end edge of the panels.

21. The flexible portfolio of claim 1 in which at least one attachment means is mounted to one of the panels adjacent to the one end edge of the panels, and a mating attachment means is mounted to said one of the panels, said mating attachment means being spaced away from said at least one attachment means, so that a portion of the portfolio adjacent to said one end edge of the panels may be folded and attached to the balance of the portfolio, said at least one attachment means and said mating attachment means being detachably attachable to each other.

22. The flexible portfolio of claim 21 in which the at least one attachment means is a first plurality of discrete attachment means, each of said first plurality of discrete attachment means being spaced from adjacent discrete attachment means and mounted to one of the panels adjacent to the one one end edge of the panels, and the mating attachment means is a second plurality of discrete attachment means mounted to the one of the panels in a rectilinear pattern substantially parallel to the one edge of the panels.

23. The flexible portfolio of claim 21 in which at least one securing means extends between the first panel and the second panel, said at least one securing means being disposed between the at least one attachment means and the mating attachment means and being spaced substantially equally from both the at least one attachment means and the mating attachment means.

24. The flexible portfolio of claim 21 in which the at least one attachment means and the mating attachment means are mating portions of a snap fastener.

25. The flexible portfolio of claim 1 in which one side of one end portion of at least one flexible rectilinear strip is attached to one of the panels, an attachment means is mounted to the other side of said one end portion of said strip, and a mating attachment means is mounted to one side of the other end portion of said strip, so that said strip may be formed into a loop, having said one end portion and said other end portion of said strip being attached to each other, said attachment means and said mating attachment means being detachably attachable to each other.

26. The flexible portfolio of claim 25 in which the attachment means and the mating attachment means are mating portions of velcro.

27. The flexible portfolio of claim 25 in which the attachment means and the mating attachment mean are mating portions of a snap fastener.

28. The flexible portfolic of claim 25 in which the number of strips is two and the two strips are mounted to the same panel and spaced apart, and wherein said strips when formed into loops are in registration, with the loops being substantially coaxial.

29. The flexible portfolio of claim 28 in which one strip is mounted to the panel adjacent to one end of the first stringer and the other strip is mounted to the panel adjacent to the other end of the first stringer, the axis of the coaxial loops when the strips are formed into loops being substantially parallel to the first stringer.

* * * * *